United States Patent [19]

Ihle

[11] 4,089,197

[45] May 16, 1978

[54] MACHINE FOR FLATTENING SHEET METAL

[75] Inventor: Josef Ihle, Pforzheim, Germany

[73] Assignee: Irma Ungerer nee Dollinger, Pforzheim, Germany

[21] Appl. No.: 799,074

[22] Filed: May 20, 1977

[30] Foreign Application Priority Data

Oct. 20, 1976 Germany ..... 2647381

[51] Int. Cl.[2] ..... B21D 1/02

[52] U.S. Cl. ..... 72/165

[58] Field of Search ..... 72/165, 164, 163, 161, 72/160

[56] References Cited

U.S. PATENT DOCUMENTS

| | | | |
|---|---|---|---|
| 2,132,426 | 10/1938 | Maussnest | 72/163 |
| 2,429,142 | 10/1947 | Thomas | 72/164 X |
| 3,626,736 | 12/1971 | Munchbach | 72/165 |

*Primary Examiner*—Milton S. Mehr

[57] ABSTRACT

A plurality of lower rolls are rotatably mounted in a machine frame below a crosshead thereof, which carries a plurality of nuts that are mounted for rotation on spaced apart vertical axes. A plurality of thrust screws are in threaded engagement with and depend from respective ones of said nuts. A plurality of spherical bearing parts are carried by respective ones of said thrust screws below said nuts. An upper yoke assembly is disposed above said lower rolls and comprises a plurality of spherical bearing sockets in mating engagement with respective ones of said spherical bearing parts to support said yoke assembly on said thrust screws. A plurality of upper yokes are rotatably mounted in said upper yoke assembly and disposed above said lower rolls and define nips therewith. Means are provided for rotating at least one of said thrust screws relative to the nut associated therewith independently of another of said thrust screws. Means are provided for rotating at least one of said thrust screws relative to the nut associated therewith in unison with another of said thrust screws.

9 Claims, 3 Drawing Figures

MACHINE FOR FLATTENING SHEET METAL

Figure 1:
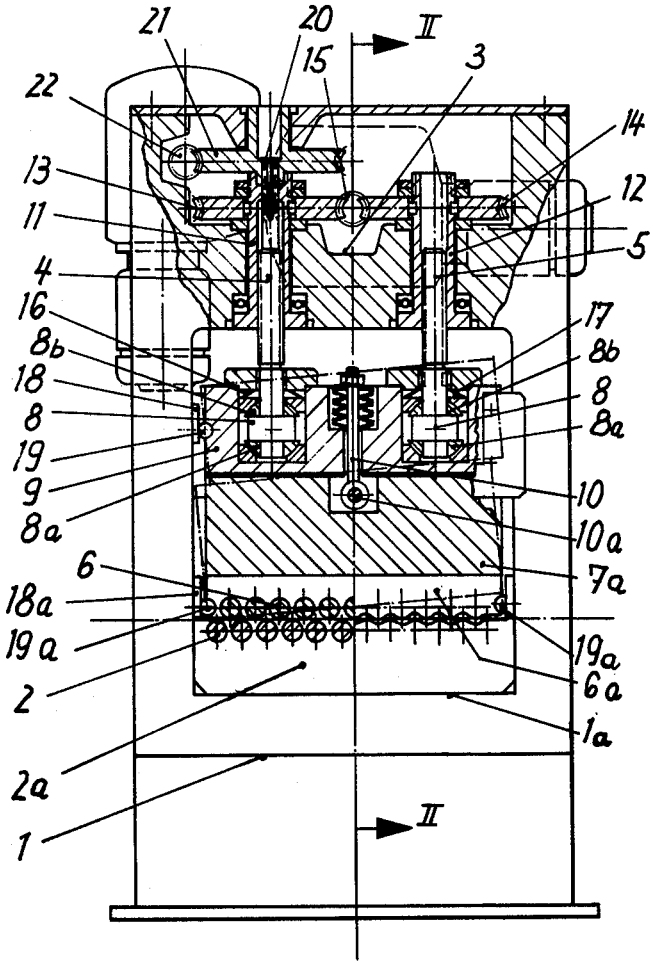

This invention relates to a machine for flattening sheet metal or strip metal, comprising double screws for axially and angularly adjusting a yoke which carries upper rolls.

In flattening machines comprising stationary lower rolls, which are mounted in a machine bed, and adjustable upper rolls, it is known to move the upper rolls by means of double screws in order to adjust the nips between the rolls. In such known machines, the upper yoke is adjustable by means of the screws and the upper rolls are rotatably mounted in a frame, which is mounted in said upper yoke by means of arcuate guides to permit of an adjustment of the upper rolls relative to the lower ones in a vertical direction and about two horizontal axes, which are, respectively, parallel and at right angles to the axes of the lower rolls.

Austrian Pat. Specification No. 302,770 discloses flattening machines comprising an upper part which is mounted in pivoted discs formed with a transverse guiding groove. In these machines, additional ball supports and guide plates are required and add to the expenditure. Besides, the upper rolls can be tilted in these known machine only in the direction of travel of the strip but cannot be tilted transversely theretoo although this is required to flatten sheet metal elements or strip metal which is undulated or saber-shaped only on one side.

It is an object of the invention to provide a structurally simple flattening machine in which the upper rolls are suspended and guided in such a manner that they can be tilted relative to the lower rolls about horizontal axes which are, respectively, parallel and at right angles to the axes of the lower rolls, as is required for a satisfactory flattening operation.

The invention is based on the results of investigations which have shown that even when upper rolls are not supported by arcuate guides they can be tilted to the usual extent with a lateral displacement that is so small that it can be taken up by the bearing clearance between the yoke which carries the upper rolls and the vertical guideways for guiding said yoke in the machine frame.

In a machine for flattening sheet metal or strip metal, comprising double screws for vertically and angularly moving a yoke which carries upper rolls, and means for adjusting said screws individually or in unison by means of nuts, which are threaded on said screws and secured to a crosshead of the machine frame and connected to respective worm wheels, the object set forth above is accomplished according to the invention in that the yoke is suspended by spherical bearings from the lower end of respective screws whereas arcuate guides are omitted, the yoke assembly which carries the upper rolls comprises a yoke, a yoke-carrying frame, which is rigid with the yoke, two beams which are disposed on opposite sides of the machine and are supported by said spherical bearings, and spring-loaded pins, by which said yoke-carrying frame is suspended from said beams and held to be slidable along the same.

Backlash at the spherical bearings will be eliminated by an arrangement which comprises a collar carried by each thrust screw, upwardly and downwardly facing, annular spherical segments mounted on said collar and in mating engagement with upper and lower spherical socket members mounted in a bearing bore, in which a disc spring is disposed which bears on the upper socket member and an overlying abutment ring rigid with the yoke assembly.

The yoke-carrying frames and the beams are guided by vertical guideways provided on upright members of the machine frame. For this purpose, flattened rollers in slidable engagement with said guideways are rotatably mounted in recesses formed on both sides of the yoke-carrying frames and beams and permit of a vertical adjustment of said yoke-carrying frame and beams and of a tilting thereof about an axis which is parallel to the axes of the lower rolls. Such recesses are provided approximately on the level of the axes of the upper rolls and on the level of the vertical center of the spherical bearings so that the yoke-carrying frame the lateral displacement of the yoke-carrying frame and beams during the tilting thereof can be minimized.

Finally, each screw of at least one pair may comprise a splined stub shaft, which extends above the nut which is associated with said screw, and a worm wheel is mounted on said splined shaft stub and rotatable independently of the other nut so that the upper yoke can be tilted.

Figure 2:
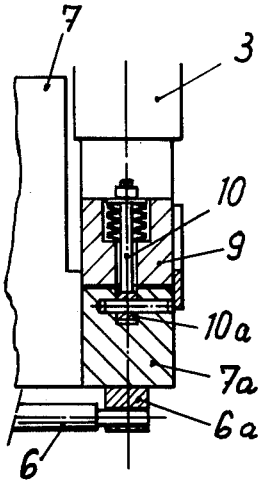
Figure 3:
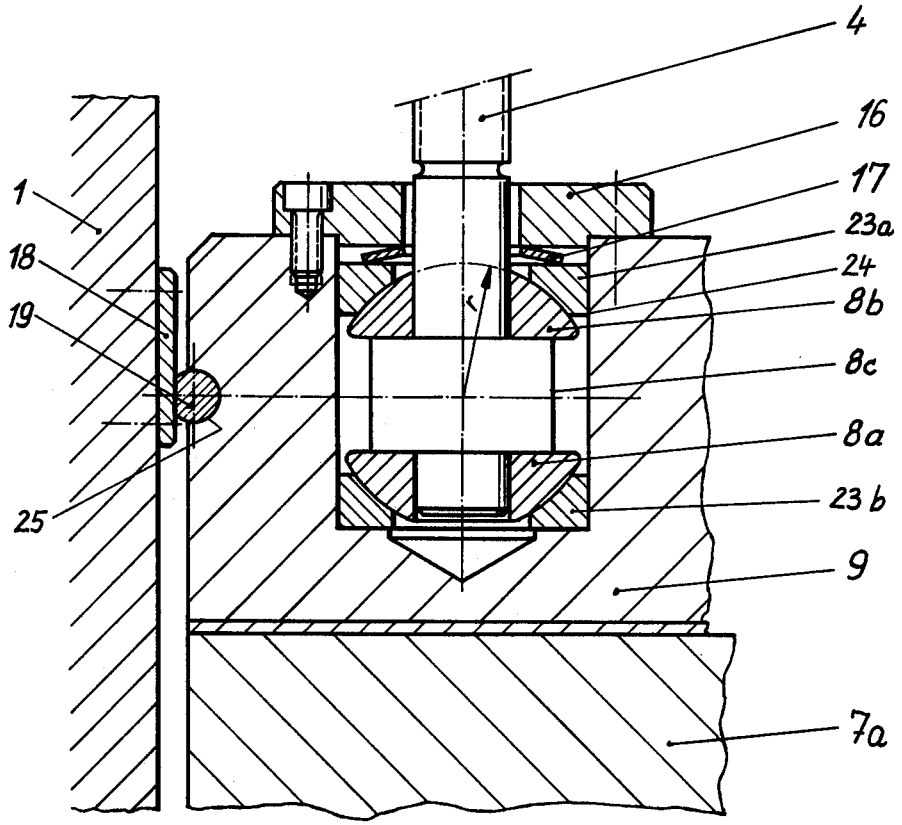

An embodiment of the flattening machine according to the invention, comprising pairs of thrust screws and spherical bearings, is shown by way of example on the drawing, in which FIG. 1 is a side elevation showing a flattening machine according to the invention, partly in section, FIG. 2 is an enlarged fragmentary view showing an upper yoke, a yoke-carrying frame, and a beam for suspending the upper rolls, and FIG. 3 is an enlarged fragmentary view showing a spherical bearing and upright frame members for guiding the upper yoke assembly.

As is apparent from the drawings, the main frame of the machine comprises an upright frame 1 having a base portion 1*a*, in which a stationary a roll-mounting frame 2*a* is mounted, which carries stationary lower rolls 2. The upright frame 1 also comprises a crosshead 3, from which an upper yoke assembly is adjustably suspended by means of pairs of thrust screws 4, 5, which are adapted to exert pressure on the sheet metal or strip metal to be flattened. Specifically, the upper roll assembly comprises an upper yoke 7 and is suspended from the screws 4, 5 by means of spherical bearings 8. The upper yoke 7 is carried by a yoke-carrying frame 7*a*, and the latter carries a roll-mounting frame 6*a*, in which the upper rolls 6 are rotatably mounted. The yoke-carrying frame 7*a* is provided on each side with a trunnion 10*a* and is suspended on opposite sides from respective beams 9 by means of spring-loaded pins 10, which are pivoted at their lower end on the respective trunnions 10*a* and hold the yoke-carrying frame 7*a*, which is held to be slidable along the beams 9. The beams 9 are mounted on the screws 4, 5 by means of the spherical bearings 8.

A nut 11 or 12 is threaded on each thrust screw 4 or 5 and is non-rotatably connected to or rigid with a worm wheel 13 or 14. The two worm wheels 13, 14 are in mesh with a common worm 15, which is operable to adjust the upper rolls 6 in height. The spherical bearings 8 from which the yoke 7 is suspended by means of the yoke-carrying frame 7*a* and the beams 9 comprise upwardly and downwardly facing annular spherical segments 8*a* and 8*b*, which are mounted on a collar 8*c* at the lower end of each thrust screw 4 or 5 and in mating engagement with upper and lower spherical socket members 23*a* and 23 *b* disposed in respective bearing bores 24 formed in the respective beams 9. To eliminate backlash, each of these bores is provided at its upper end with an abutment ring 16 and with a disc spring 17 bearing on the upper spherical socket member 23*a* and the overlying abutment ring 16, and the upper spherical socket member 23*a* is axially slidable in the bore 24. The beams 9 which carry the yoke-carrying frames 7*a*, as well as the roll-mounting frames 6*a*, which are secured to the frames 7*a* and carry the upper rolls 6, are guided on both sides on vertical guideways 18 and 18*a*, respectively, which are provided on upright members of the upright frame and which are slidably engaged by flattened rollers 19 and 19*a*, which are rotatably mounted in mating recesses 25 formed in the beams 9 and in the roll-mounting frame 6*a* so that the assembly 6, 6*a*, 7, 7*a*, 9 can be adjusted in height and about horizontal axes which are, respectively, parallel and at right angles to the axes of the lower rolls. A first set of these flattened rollers are designated 19 and disposed on the level of the centers of the spherical bearings 8. A second set of these flattened rollers are designated 19*a* and disposed approximately on the same level as the axes of the upper rolls 6. As is indicated in the drawings by dash-dot lines, this arrangement permits of an angular movement of the yoke 7 and of the upper rolls 6 carried thereby toward the entrance or exit for the sheet metal, as is exaggeratedly indicated by dash-dot lines in FIG. 1. For this purpose, one thrust screw 4 comprises a splined shaft stub 20, which extends above the associated nut 11 and on which a worm wheel 21 is non-rotatably mounted, so that the yoke 7 can be adjusted at one end independently of the above-described means for adjusting the yoke at both ends in unison.

FIG. 1 shows the two thrust screws 4 and 5 provided on one side of the machine. Two similar thrust screws are provided on the other side of the machine and are suspended like the thrust screws 4, 5 shown on the drawing. It will be understood that the upper rolls can be tilted about a horizontal axis which is transverse to the axes of the lower rolls 2 if either the two thrust screws 4 and 5 shown in FIG. 1 or the two similarly arranged thrust screws disposed on the opposite side of the machine are operated in unison and that the upper rolls 6 can be vertically adjusted if all four thrust screws are operated in unison.

In FIG. 3, the spherical bearing 8 for mounting a thrust screw 4 in the beam 9, connected to the yoke-carrying frame 7*a*, is shown on a larger scale than in FIG. 1. The annular spherical segments 8*a* and 8*n* are mounted at both ends of the collar 8*v* and bear on upper and lower spherical socket members 23*a*, 23*b*. The upper spherical socket member 23*a* is axially slidable in the bearing bore 24 so that the backlash in the bearing is eliminated by the disc spring 17, which abuts on the fixed abutment ring 16. FIG. 3 shows also the guide 18 which is provided on the upright frame 1 and guides the flattened guide roller 19, which is rotatable in the recess 25.

I claim:

1. A machine for flattening sheet metal, comprising
a machine frame including a crosshead,
a plurality of lower rolls rotatably mounted in said machine frame below said crosshead,
a plurality of nuts carried by said crosshead and mounted for rotation on spaced apart vertical axes,
a plurality of thrust screws, which are in threaded engagement with and depend from respective ones of said nuts,
a plurality of spherical bearing parts carried by respective ones of said thrust screws below said nuts,
an upper yoke assembly disposed above said lower rolls and comprising a plurality of spherical bearing sockets in mating engagement with respective ones of said spherical bearing parts to support said yoke assembly on said thrust screws,
a plurality of upper rolls rotatably mounted in said upper yoke assembly and disposed above said lower rolls and defining nips therewith,
means for rotating at least one of said thrust screws relative to the nut associated therewith independently of another of said thrust screws, and
means for rotating at least one of said thrust screws relative to the nut associated therewith in unison with another of said thrust screws.

2. A machine as set forth in claim 1, in which
said lower rolls are mounted for rotation on horizontal axes which extend in a first direction and are horizontally spaced apart in a second direction, which is at right angles to said first direction,
said upper rolls are mounted for rotation on axes which are generally parallel to said first direction,
said thrust screws comprise first and second thrust screws, which are aligned and spaced apart in said second direction,
means are provided for rotating one of said first and second thrust screws relative to the nut associated therewith independently of the other of said first and second thrust screws, and
means are provided for rotating both said first and second thrust screws in unison relative to the associated nuts.

3. A machine as set forth in claim 2, which
said thrust screws comprise first and second pairs of thrust screws, which comprise said first and second thrust screws, respectively,
the thrust screws of each of said pairs are spaced apart in said first direction,
means are provided for rotating the thrust screws of each of said pairs relative to the nuts associated therewith in unison with each other and independently of the thrust screws of the other of said pairs, and
means are provided for rotating one thrust screw of each of said pairs relative to the nut associated therewith independently of the other thrust screw of said pair.

4. A machine as set forth in claim 2, in which
a worm wheel is non-rotatably connected to each of the nuts in threaded engangement with said first and second thrust screws and
a common worm is in mesh with both said worm wheels and rotatable to rotate said first and second thrust screws in unison relative to the nuts associated therewith.

5. A machine as set forth in claim 4, in which
said first thrust screw has a shaft stub above the associated nut,
an additional worm wheel is non-rotatably connected to said stub shaft, and
an additional worm is in mesh with said additional worm wheel and rotatable to rotate said first thrust screw relative to the associated nut independently of said second thrust screw.

6. A machine as set forth in claim 5, in which said stub shaft is splined.

7. A machine as set forth in claim 1, in which said upper yoke assembly comprises a yoke member disposed above said upper rolls, a horizontal yoke-carrying frame rigid with said yoke member, two horizontal beams which are disposed above said yoke-carrying frame and extend in a direction which is transverse to the axes of said upper rolls and are spaced apart in the direction of the axes of said upper rolls and carry said spherical bearing sockets, and two spring-loaded pins, by which said yoke-carrying frame is suspended from respective ones of said beams and held to be slidable along the same.

8. A machine as set forth in claim 7, in which said machine frame comprises uprights, which are horizontally spaced apart transversely to the axes of said upper rolls and are provided with vertical guideways facing said upper yoke assembly, said yoke-carrying frame is formed with recesses, which are arcuate in cross-section and face respective ones of said guideways and are disposed on the level of said upper rolls, said beams are formed with recesses, which are arcuate in cross-section and face respective ones of said guideways and are disposed on the level of the centers of said spherical bearing parts, and a plurality of rollers are provided, each of which has curved peripheral portion rotatably mounted in one of said recesses and a flat peripheral portion in guided engagement with one of said guideways, whereby said recesses, rollers, and guideways permit of a vertical movement of said yoke assembly relative to said machine frame and a tilting movement of said yoke assembly about an axis which is transverse to the axes of said upper rolls.

9. A machine as set forth in claim 1, in which each of said spherical bearing parts comprises a collar mounted on said thrust screw below the nut associated therewith, an upwardly facing upper annular spherical segment carried by said collar, and a downwardly facing lower annular spherical segment carried by said collar, said upper yoke assembly is formed with a plurality of bearing bores, which contain respective ones of said sockets, each of said sockets comprises a downwardly facing upper spherical socket member axially slidably mounted in the associated bearing bore and in mating engagement with said upper annular shperical segment, and an upwardly facing lower spherical socket member in mating engagement with said lower annular spherical segment, an abutment ring is secured to said yoke assembly at each of said bores and overlies said upper socket member therein, and a disc spring is interposed in each of said bearing bores and engages said upper socket member therein and the overlying abutment ring and urges said upper socket member against said upper annular spherical segment in said bore.

* * * * *